US008581726B2

(12) United States Patent
Piccoli et al.

(10) Patent No.: US 8,581,726 B2
(45) **Date of Patent: *Nov. 12, 2013**

(54) TWO-STAGE UNIVERSAL SECURITY HARD TAG AND METHOD FOR ATTACHING AND DETACHING

(75) Inventors: Anthony F. Piccoli, West Deptford, NJ (US); Lawrence Appalucci, Villanova, PA (US); James Brodzik, Somerdale, NJ (US); Gary Mazoki, Sewell, NJ (US); Thomas J. McKeown, Pennsauken, NJ (US); Seth Strauser, Sewell, NJ (US)

(73) Assignee: Checkpoint Systems, Inc., Thorofare, NJ (US)

( * ) Notice: Subject to any disclaimer, the term of this patent is extended or adjusted under 35 U.S.C. 154(b) by 537 days.

This patent is subject to a terminal disclaimer.

(21) Appl. No.: 12/887,229

(22) Filed: Sep. 21, 2010

(65) Prior Publication Data

US 2011/0018716 A1 Jan. 27, 2011

Related U.S. Application Data

(63) Continuation-in-part of application No. 12/482,934, filed on Jun. 11, 2009, now Pat. No. 8,344,891.

(60) Provisional application No. 61/157,237, filed on Mar. 4, 2009, provisional application No. 61/163,677, filed on Mar. 26, 2009.

(51) Int. Cl.

| | |
|---|---|
| ***G08B 13/14*** | (2006.01) |
| ***E05B 63/00*** | (2006.01) |
| ***E05B 65/00*** | (2006.01) |
| ***E05B 69/00*** | (2006.01) |

(52) U.S. Cl.

USPC ..... 340/568.1; 340/568.4; 340/568.5; 340/571; 340/572.1; 70/4; 70/6; 70/57.1; 70/58

(58) Field of Classification Search

None

See application file for complete search history.

(56) References Cited

U.S. PATENT DOCUMENTS 4,502,305 A * 3/1985 Bakker ..... 70/49
4,546,345 A 10/1985 Naito (Continued)

FOREIGN PATENT DOCUMENTS

CN 201122327 Y 9/2008
EP 1548640 6/2005

(Continued)

OTHER PUBLICATIONS

International Search Report for related PCT Application No. PCT/US2011/051593 dated Feb. 17, 2012.

*Primary Examiner* — Julie Lieu

(74) *Attorney, Agent, or Firm* — Caesar, Rivise, Bernstein, Cohen & Pokotilow, Ltd.

(57) ABSTRACT

A security tag that is attached to an article in two stages. In a first stage, a first portion of an attachment clip is coupled to an article, such as but not limited to clothing, to be protected by a manufacturer or assembler. This attachment clip is durable to withstand harsh manufacturing environments. Once the article with the attachment clip is ready for presentation, for example, at a retail establishment, during a second stage, a second portion of the attachment clip is then permanently secured in a locking mechanism of a housing containing a security element therein. The security element may comprise EAS (including AM, RF, EM and microwave), RFID (including LF, HF and UHF), benefit denial (e.g., ink-filled or dye-filled capsules) elements or any combination thereof. Because the security tag is not removed from the article at the point-of-sale, the security element is deactivatable. A preferred embodiment of the security tag uses all non-ferrous components including its locking mechanism. Thus, the security tag combines the qualities of being non-ferrous, lightweight, low cost, deactivatable, secure, visually-deterring, and installable in two stages to the article it is meant to protect.

41 Claims, 6 Drawing Sheets

(56) References Cited

U.S. PATENT DOCUMENTS

| | | | | |
|---|---|---|---|---|
| 5,070,581 | A | 12/1991 | Senter | |
| 5,508,684 | A * | 4/1996 | Becker | 340/572.5 |
| 5,515,580 | A | 5/1996 | McHenry, Jr. | |
| 5,524,463 | A * | 6/1996 | Schenkel et al. | 70/57.1 |
| 5,535,606 | A * | 7/1996 | Nguyen et al. | 70/57.1 |
| 5,583,489 | A | 12/1996 | Loemker et al. | |
| 5,615,454 | A | 4/1997 | Contarino | |
| 5,627,520 | A * | 5/1997 | Grubbs et al. | 340/572.1 |
| 5,689,237 | A | 11/1997 | Sasagawa et al. | |
| 5,699,591 | A | 12/1997 | Kane | |
| 5,945,909 | A * | 8/1999 | Kolton | 340/572.1 |
| 5,969,613 | A * | 10/1999 | Yeager et al. | 340/572.9 |
| 6,052,876 | A | 4/2000 | Hogan et al. | |
| 6,188,320 | B1 * | 2/2001 | Kolton et al. | 340/572.9 |
| 6,254,953 | B1 | 7/2001 | Elston | |
| 6,380,855 | B1 | 4/2002 | Ott | |
| 6,624,753 | B2 | 9/2003 | Elston | |
| 6,646,554 | B1 | 11/2003 | Goff et al. | |
| 6,780,265 | B2 | 8/2004 | Bleckmann et al. | |
| 7,129,841 | B2 | 10/2006 | Feibelman | |
| 7,183,914 | B2 | 2/2007 | Norman et al. | |
| 7,183,917 | B2 | 2/2007 | Piccoli et al. | |
| 7,227,467 | B2 | 6/2007 | Feibelman | |
| 7,456,741 | B2 | 11/2008 | Norman et al. | |
| 7,474,209 | B2 | 1/2009 | Marsilio et al. | |
| 7,518,521 | B2 * | 4/2009 | Feibelman et al. | 340/572.9 |
| 7,808,390 | B2 | 10/2010 | Sayegh | |
| 2006/0026809 | A1 * | 2/2006 | Copen et al. | 24/704.1 |
| 2006/0238343 | A1 * | 10/2006 | Leyden et al. | 340/572.1 |
| 2009/0135014 | A1 | 5/2009 | Bleckmann et al. | |
| 2010/0225485 | A1 | 9/2010 | Appalucci et al. | |
| 2011/0199210 | A1 | 8/2011 | McLean | |

FOREIGN PATENT DOCUMENTS

| | | |
|---|---|---|
| EP | 1171300 | 11/2005 |
| GB | 2187706 | 9/1987 |
| GB | 2305212 | 4/1997 |
| JP | 2002074530 | 3/2002 |
| KR | 20030079036 | 10/2003 |
| KR | 20050020918 | 3/2005 |
| WO | 98/40591 | 9/1998 |
| WO | 2006/127674 | 11/2006 |
| WO | 2008/068725 | 6/2008 |

* cited by examiner

FIG.1
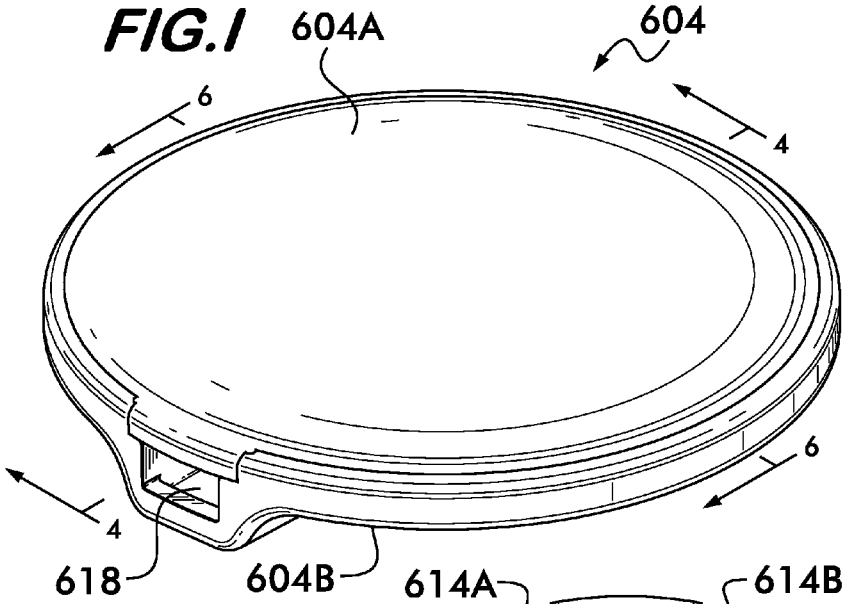
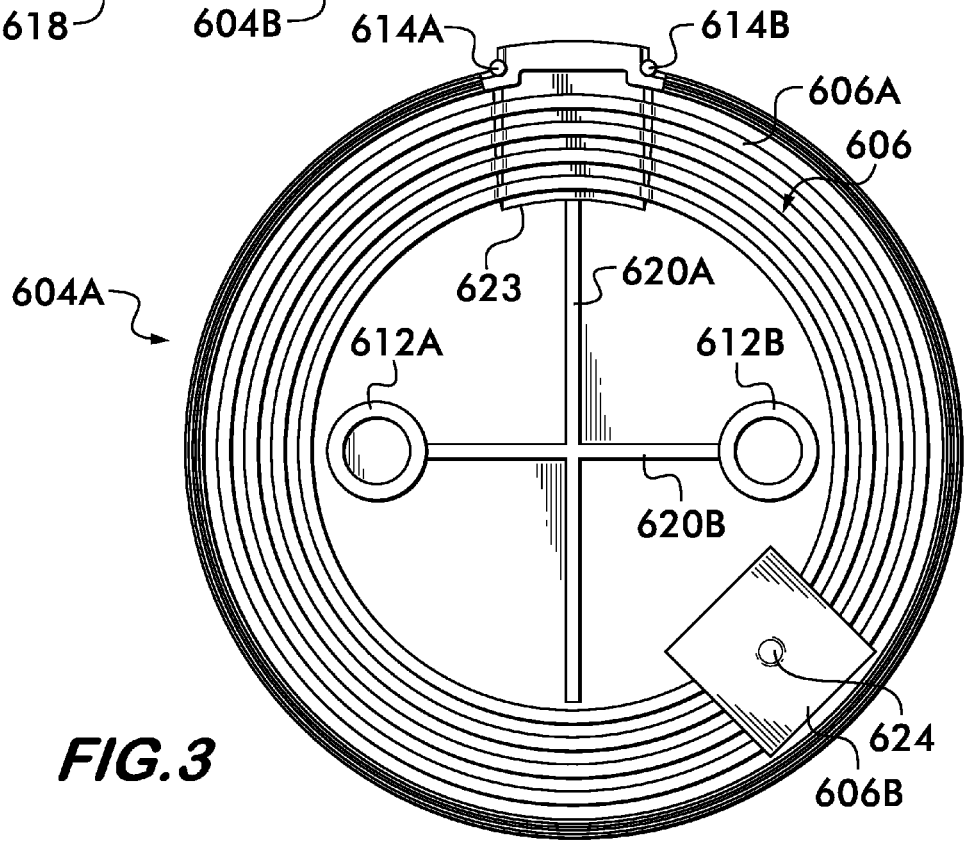
FIG.3

604A
606A
604B
608
608
626
626
618
622
602
622A 606A
604B
604A
608
622A
626
602
618
626
608

606A
604B
612A
610A
604A
612B
610B
606A

TWO-STAGE UNIVERSAL SECURITY HARD TAG AND METHOD FOR ATTACHING AND DETACHING

CROSS-REFERENCE TO RELATED APPLICATIONS

This continuation-in-part application claims the benefit under 35 U.S.C. §120 of application Ser. No. 12/482,934 filed on Jun. 11, 2009 entitled SECURITY HARD TAG WITH ATTACHMENT CLIP AND METHOD FOR ATTACHING AND DETACHING which, in turn, claims the benefit under 35 U.S.C. §119(e) of Provisional Application Ser. No. 61/157,237 filed on Mar. 4, 2009 entitled NON-FERROUS HARD TAG and of Provisional Application Ser. No. 61/163,677 filed on Mar. 26, 2009 also entitled NON-FERROUS HARD TAG and all of whose entire disclosures are incorporated by reference herein.

BACKGROUND OF THE INVENTION

1. Field of Invention

The present invention generally relates to the field of security tags, and more particularly, to hard tags which are coupled to articles.

2. Description of Related Art

Many apparel items are tagged (i.e., a security device or element applied) at the source. These security devices may comprise electronic article surveillance (EAS) elements, radio frequency identification (RFID) elements or combinations of such security devices, etc., and which can be wirelessly detected at business portals, e.g., store exits or points of sale (POS), etc. to prevent or diminish theft from the business. Most conventional hard tags on the market utilize a metallic pin and lock mechanism to secure the tag to an article (e.g., clothing) for protecting the article against theft. Once the hard tag is then installed on or with the article, to prevent any broken sewing needle from imbedding itself into the clothing and possibly causing harm to the end user, especially children, the article is subjected to a required needle detector test. The needle detector (e.g., the HN-25 Needle Detector by Hashima Co. Ltd. of Japan) senses a change in magnetic field and alarms if a ferrous metal enters into its sensing field; these detectors typically have two settings based on the quantity of iron in a steel ball of 0.8 mm (high) or 1.2 mm (low). There are also significant legal liabilities if a broken needle leaves the factory.

Conventional security tags such as EAS hang tags, sewn-in woven tags, and drop-in-pocket tags are non-ferrous, light weight, low cost, and deactivatable, but they are not visually-deterring and cannot be secured (at least in part) prior to harsh manufacturing conditions (e.g., stone-washing of jeans). Furthermore, EAS hang tags attached by a plastic strap and un-attached drop-in-pocket tags can easily be removed and are not secure.

Magnetic hard tags are visually deterring and secure (by a metal pin), but they are not non-ferrous, light weight, low cost, deactivatable, or capable of being secured prior to harsh manufacturing conditions. Rather, these tags must be removed at checkout (rather than being deactivated), and must be secured by a metal (ferrous) pin after the object to be tagged has undergone any harsh manufacturing conditions.

In addition, the actual tagging of the security device/element to the apparel can affect the presentation of the apparel by either puncturing the apparel (e.g., pin and receptacle) or by adhering to the apparel, or by being embedded (e.g., sewn) within the apparel. Further, the weight of the tag may distort or wrinkle the fabric when the apparel is positioned on the hanger, the mannequin, or other display.

This is most apparent in many apparel items such as intimates, bathing suits and accessories but also occurs with soft goods. Soft goods include homeware items such as bedding, towels, fabrics, etc. Thus, these types of goods do not favor the known security devices and methods for attaching such devices due to the size of the goods or the invasive nature of the products known in the art. The attachment of a security device embedded in packaging for apparel, linens and soft goods is known in the art. A woven label such as that shown in U.S. Pat. No. 6,780,265 (Bleckmann, et al.) has an embedded EAS or RFID device.

The method of attaching such a woven label by a sewing machine is also known in the art. Other methods are disclosed where the device is embedded within a paper ticket, price tag or hang tag (swing ticket). These products are also attached by known methods. By way of example, see U.S. Pat. Nos. 5,508,684 (Becker); 5,583,489 (Loemaker, et al.); 6,254,953 (Elston); and EP 1171300 (Bleckmann, et al.). But as discussed above, sewn-in woven tags are not visually-deterring and cannot be secured (at least in part) prior to harsh manufacturing conditions.

Moreover, where RFID security devices are used, many people have an apprehension with such devices when they are used in connection with personal items because it harbors connotations of invasion of privacy. RFID security devices typically include a memory regarding the item itself. Where such security devices are sewn into apparel, people are reluctant to purchase apparel that may permanently contain a device that may store information and which cannot be removed without damaging the apparel. Thus, the use of RFID security devices tends to increase the "impact" of such security devices on apparel.

One solution, U.S. Patent Publication No. 2006/0026809 (Copen, et al.), which is owned by the same Assignee, namely, Checkpoint Systems, Inc., as the present application, discloses several embodiments, one of which (referred to as a "slotted EAS tag holder") has a housing and an attachment cable, but the attachment cable can only be attached to the article by being attached to the housing. As a result, this security tag cannot undergo harsh manufacturing conditions. In addition, this security tag does not utilize a deactivatable security element.

Another solution is that disclosed in A Ser. No. 12/482,934, filed Jun. 11, 2009, entitled "Security Hard Tag with Attachment Clip and Method for Attaching and Detaching" and which is owned by the same Assignee, namely, Checkpoint Systems, Inc., as the present application. In particular, A Ser. No. 12/482,934 discloses a non-ferrous, light weight, low cost, secure, and visually-deterring tag; however, this tag is not deactivatable and cannot undergo harsh manufacturing conditions.

Thus, there remains a need for a security tag that can combine the qualities of being non-ferrous, light weight, low cost, deactivatable, secure, visually-deterring, and capable of being attached (at least in part) at the source (e.g., a garment factory) prior to harsh manufacturing conditions (e.g., stone washing of jeans).

BRIEF SUMMARY OF THE INVENTION

A security tag adapted for securing to an article (e.g., an article such as, but not limited to, clothing, especially children's clothing, lingerie, shoes, shirts, pants, swimwear and most outerwear, etc.) is disclosed. The security tag comprises: a housing; a locking mechanism associated with the housing;

an attachment clip which comprises: a first portion configured to secure to the article independently of the housing; and a second portion configured to secure within the locking mechanism of the housing, and a security element (e.g., EAS (including AM, RF, EM and microwave), RFID (including LF, HF and UHF), benefit denial (e.g., ink-filled or dye-filled capsules) or any combination thereof, etc.) associated with the housing, wherein the security element prevents or hinders a theft of the article.

A method is disclosed for securing a security tag to an article (e.g., an article such as, but not limited to, clothing, especially children's clothing, lingerie, shoes, shirts, pants, swimwear and most outerwear, etc.). The method comprises: (a) receiving the article, wherein an attachment clip is secured to the article and wherein the attachment clip comprises: a first portion configured to secure the attachment clip to the article; and a second portion configured to secure within a housing; and (b) locking the second portion within the housing to form the security tag wherein the housing comprises: a locking mechanism configured to receive the second portion of the attachment clip; and a security element (e.g., EAS (including AM, RF, EM and microwave), RFID (including LF, HF and UHF), benefit denial (e.g., ink-filled or dye-filled capsules) or any combination thereof, etc.).

A method is disclosed for securing a security tag to an article (e.g., an article such as, but not limited to, clothing, especially children's clothing, lingerie, shoes, shirts, pants, swimwear and most outerwear, etc.). The method comprises: (a) securing an attachment clip to the article wherein the attachment clip comprises a first portion for securing to the article and a second portion which is adapted for securing to a housing of the security tag, and wherein the step of securing an attachment clip to the article is accomplished with the second portion remaining uncoupled to the housing; and (b) locking the second portion of the attachment clip within the housing having a security element (e.g., EAS (including AM, RF, EM and microwave), RFID (including LF, HF and UHF), benefit denial (e.g., ink-filled or dye-filled capsules) or any combination thereof, etc.) therein, wherein the housing comprises a locking mechanism configured to receive the second portion of the attachment clip.

An attachment clip for securing a security element (e.g., EAS (including AM, RF, EM and microwave), RFID (including LF, HF and UHF), benefit denial (e.g., ink-filled or dye-filled capsules) or any combination thereof, etc.) to an article (e.g., an article such as, but not limited to, clothing, especially children's clothing, lingerie, shoes, shirts, pants, swimwear and most outerwear, etc.) is disclosed. The attachment clip comprises a first portion configured to secure to the article and a second portion configured to couple to a housing comprising the security element therein.

A security element apparatus adapted for permanently coupling to an attachment clip that is secured to an article (e.g., an article such as, but not limited to, clothing, especially children's clothing, lingerie, shoes, shirts, pants, swimwear and most outerwear, etc.) is disclosed. The security element apparatus comprises: a housing; a security element (e.g., EAS (including AM, RF, EM and microwave), RFID (including LF, HF and UHF), benefit denial (e.g., ink-filled or dye-filled capsules) or any combination thereof, etc.) associated with the housing, wherein the security element prevents or hinders a theft of the article when the housing is attached to the attachment clip; and a locking mechanism associated with the housing and adapted for permanently receiving a portion of the attachment clip attaching the security tag to the article.

BRIEF DESCRIPTION OF SEVERAL VIEWS OF THE DRAWINGS

The invention will be described in conjunction with the following drawings in which like reference numerals designate like elements and wherein:

FIG. 1 is an isometric view of the housing portion of the security tag of the present invention and depicting an aperture to the locking mechanism for receiving a portion of an attachment clip;

FIG. 3 is a plan view of the first portion of the housing showing the exemplary security element therein;

DETAILED DESCRIPTION OF THE INVENTION

Figure 2:
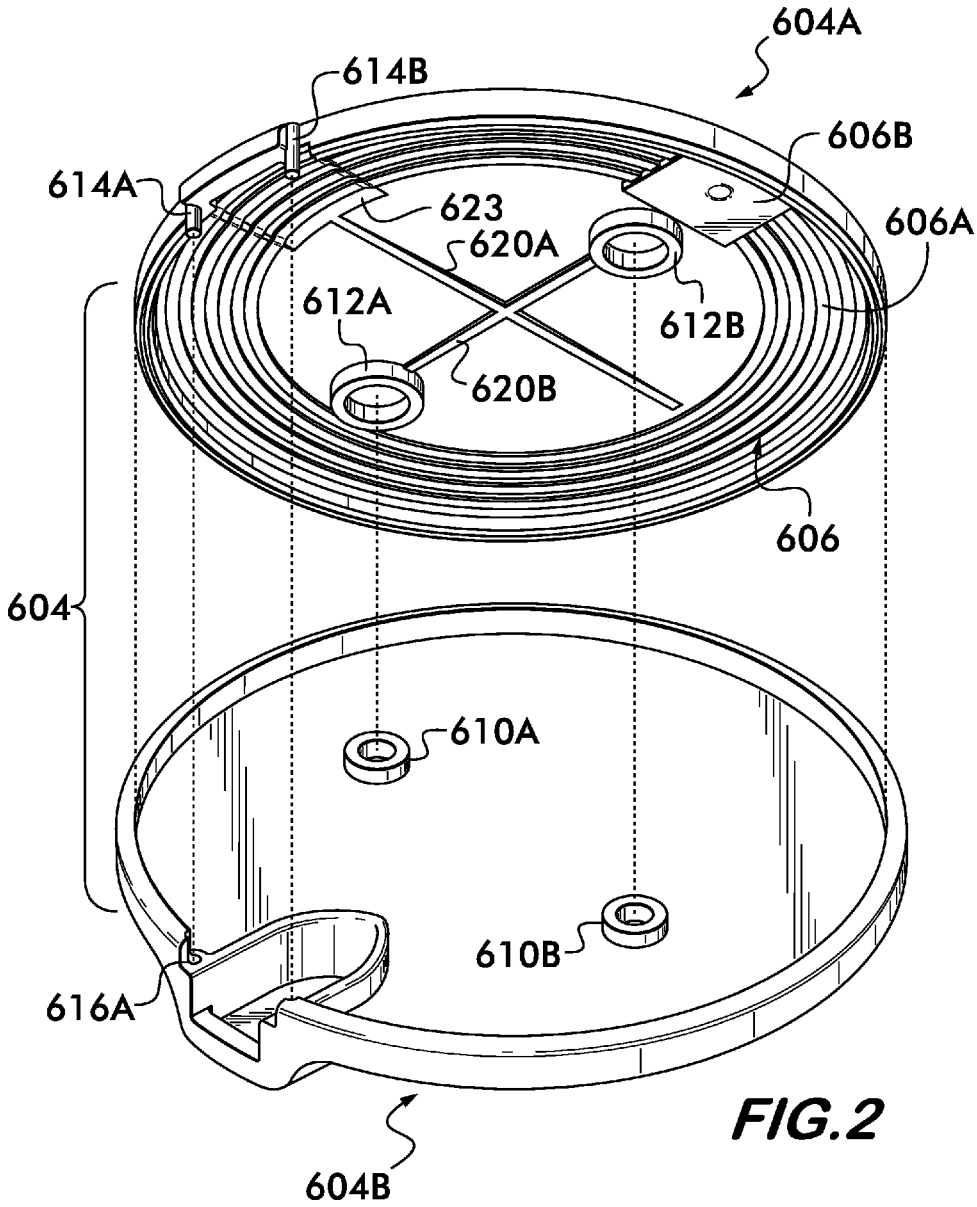
FIG. 2 is an exploded view of the housing of FIG. 1 showing the internals of the housing, including a first or upper portion containing an exemplary security element (e.g., a capacitor/coil resonant security element) and a second or lower portion.

The present invention provides a novel security hard tag that can be attached to a variety of items with minimal impact to the presentation of the article to potential customers of the article, reducing the weight of conventional hard tags, complying with needle tests and being versatile to include any type of security element technology such as, but not limited to: EAS (electronic article surveillance, which includes AM, RF, EM and microwave), RFID (radio frequency identification, which includes LF, HF and UHF), benefit denial (e.g., ink-filled or dye-filled capsules that eject ink/dye upon illicit attempts to remove capsule, or visual alarm, or audible alarm or tactile alarm or any item that cannot be removed from the article (unless the article is validly purchased) that hinders or prevents the theft and/or denies the benefit of the article to the would-be thief) or any combination thereof. Therefore, whether the security element involves wireless transmissions (e.g., responding to a magnetic or electromagnetic field of a particular frequency or frequencies, or operates independently of any wireless transmissions (e.g., benefit-denial, visual/audible/tactile alarms, or anything that would draw attention to the non-authorized possession of the article, etc.), the term "security element" as used throughout the specification is meant to include any and all of these types of theft prevention-hindrance-benefit denial devices. Furthermore, it should be understood that in all of the subsequent discussion, the type of security element associated with the novel security tag forms no limitation on the invention.

As shown in FIGS. 7-11 and 13, the security tag invention 600 of the present application involves an attachment clip 602 (which is the general reference to all of the exemplary attachment clips 602A-602F shown in FIGS. 7-13) and an associated housing 604 which includes a security element 606 (FIGS. 2-3) and a locking mechanism 608 (FIG. 4) for receiving one portion of the attachment clip 602. Once this portion of the attachment clip 602 is secured within the locking mechanism 608, the attachment clip 602 cannot be extracted without damaging the housing 604. Another portion of the attachment clip 602 is used to the secure it to the article which is to be protected. One of the key features of this configuration is that this permits the attachment clip 602 to be initially secured to the article by itself without the housing 604 coupled thereto. This is an important feature of the present invention 600 because it allows an article manufacturer or assembler to only secure one portion, i.e., the attachment clip 602, of the security tag 600 to the article at a first location (e.g., the article manufacturing or assembly facility) while the housing 604 is secured to the attachment clip 602 at a different second location (e.g., a retail establishment, etc.). As a result, the housing 604 does not have to be provided to the article manufacturer or assembler. Furthermore, since the attachment clip 602 is the only portion of the security tag 600 attached to the article by the manufacturer or assembler, the article can be processed in its normal course which, in many circumstances, may include being subjected to harsh manufacturing environments (e.g., if the article is a pair of jeans, the harsh manufacturing environment may involve "stone-washing") to which the attachment clip 602 is impervious or which does not interfere with the attachment clip's function. This also avoids the need to ship the housing 604 portion of the security tag 600 and similarly eliminates the potential of damaging the housing 604 during shipping to, or from, the manufacturer or assembler.

Therefore, the security tag 600 is attached to the article in two stages. In the first stage, the attachment clip 602 is attached to the article during preparation or assembly of the article. Unlike a complete security tag (e.g., one which includes a security element), this attachment clip 602 is attached to the article before the article has been treated (e.g., if the article is a pair of jeans, the attachment clip is secured to the jeans, e.g., via a belt loop, after which the jeans are then dyed or pre-washed) without suffering damage. In a second stage, after the article is treated and/or shipped to a presentation location (e.g. a retail environment), the housing 604 containing the security element is then attached to the attachment clip 602. Since the attachment clip 602 is already secured to the article, the housing 604 can be attached quickly to the article by simply snapping the housing 604 and attachment clip 602 together. The attachment of the housing 604 can be accomplished at a retail establishment thousands of miles away from the article preparation facility or location.

To that end, the term "attachment clip" as used throughout this Specification is meant to include any type of element that includes a first portion for securing to the article independently of the housing portion and which a includes a second portion for securing to the housing portion. Although several variations of the attachment clip (e.g., 602A-602F) are provided in the drawings, it should be understood that these are by way of example only and that the attachment clip is not limited to just those shown. Furthermore, to pass the "needle test" discussed previously, the attachment clip 602 comprises a non-ferrous material, preferably plastic.

As mentioned previously, once the housing 604 is coupled to the attachment clip 602, the security tag 600 is secured to the article. As a result, upon the valid purchase or other type of transaction, the security element inside the housing must be "deactivated" to avoid setting off alarms or other warnings at interrogation pedestals or readers located at the retail environment exits. Such deactivation can be achieved in a number of ways and the following description is by way of example only. In particular, the housing 604 is placed within a zone of deactivation of a deactivator at the point-of-sale (POS) which physically or electronically alters the security element such that it no longer resonates in the frequency range of the retail establishment's interrogation pedestal(s) or readers. The customer must remove the security tag by severing (e.g., using a scissors to cut) the fluke stem of the attachment clip 602 (as will be described later) and thereby remove the security tag 600 from the article. The customer can also remove the security tag 600 in other ways (e.g., removing the threads that attach the clip 602 to the article, as will be discussed in detail later).

FIGS. 1-3 are directed to the housing portion 604 of the security tag 600 of the present invention. One of the important features of the present invention 600 is that it is lightweight, (e.g., less then 5 grams) thereby minimizing the impact it has on articles that are hung or otherwise displayed for customer consideration. By way of example only, as shown in FIGS. 7-11 and 13, the security hard tag 60 is shown secured to a various articles. As will be discussed in detail later, the security hard tag's attachment clip may be positioned through a button hole 2 (FIG. 7) of an article A1 or through a belt loop 4 of a pants garment A2 (FIG. 9), etc. Because the security hard tag 600 is lightweight, it does not cause the shirt or pants to droop or sag, thereby providing a nice impression or display for customers.

The shape of the housing portion 604 is shown in the figures as a round shape but it should be understood that that is only by way of example and that an unlimited number of shapes (e.g., rectangular, triangular, etc.) can be used for the housing portion 604. Regardless of the selected shape for the housing 604, the size of the housing 604 is large enough (e.g., it has an outer dimension greater than 31.9 mm, the choking threshold standard) to avoid being a choking hazard to an infant or toddler.

As shown most clearly in FIGS. 1-3, the housing portion 604 comprises a first or upper portion 604A and a second or lower portion 604B that are fixedly secured (e.g., ultrasonically welded) together. Male guidance rings 610A/610B in the second portion 604B are seated within female guidance rings 612A/612B when the two portions 604A/604B are secured together. Similarly, pegs 614A/614B located on the perimeter of the first portion 604A are seated within corresponding holes (only one of which, 616A, is shown) when the two portions 604A/604B are secured together. The pegs 614A/614B ensure that a proper aperture 618 (FIG. 4) for the locking mechanism 608 is formed when the two portions 604A/604B are secured together. Reinforcement ribs 620A and 620B are also formed in the first portion 604A. All parts of the housing portion 604 comprise non-ferrous material, e.g., plastic. In fact, all portions, internal and external, of the housing 604, i.e., the first portion 604A and the second portion 604B comprise plastic (e.g., polyethylene, PVC (poly vinyl chloride) including polymers, other plastic materials, acrylonitrile-butadiene-styrene).

Also within the housing 604 is a security element 606 (FIGS. 2-3). As mentioned previously, by way of example only, the security element 606 may comprise an EAS element comprising a coil 606A and capacitor 606B (see FIGS. 2-3). Although not shown, the coil 606A/capacitor 606B may be formed on a substrate layer (not shown that permits the security element 606 to be manipulated during assembly. The coil 606A is positioned within the first portion 604A. As mentioned previously, the security element 606 may comprise a variety of security elements such as but not limited to RF, RFID, AM, etc., and may include an antenna in place of the coil 606A. The components of the security element 606 are typically aluminum and/or copper, i.e., non-ferrous, so there is no possibility of the needle detector test being triggered by the presence of the security element 606. The security tag 606 is positioned within the housing 604 to avoid any interference with the locking mechanism 608 or with attachment clip end 622 during entry. A pad 623 is provided to which a portion of the coil 606A is adhered to prevent the entry of the fluke 622 (as will be discussed later) from snagging the coil 606A. Thus, should a thief attempt to remove the article with the security tag 600 still coupled to the article, pedestals (not shown) at the retail establishment exit (also not shown) will detect the presence of the internal security element 606 and set off an alarm.

As mentioned previously, since the housing 604 is not removed at the POS, there must be a way of deactivating the security element 606 at the POS once the article to which the security tag 600 is attached is validly purchased. Although there are several ways of deactivating a security element, one exemplary method is to use a "dimple" 624 positioned on one of the capacitor plates of the capacitor 606B. By way of example only, the dimple 624 is shown in FIG. 3. To that end, the dimple 624 basically comprises an indented or weakened portion of the capacitor plate. When this dimple 624 is subjected to a particular voltage pulse (from a deactivator, not shown, located at the POS), the pulse causes the capacitor plates to short together or otherwise alter the resonant frequency of the security element 606 such that when the article along with the security tag pass through the interrogation pedestals at the retail establishment exit, the security element will not respond to the interrogation signal of the pedestals and thus no alarm is triggered.

Figures 4, 5, 6:
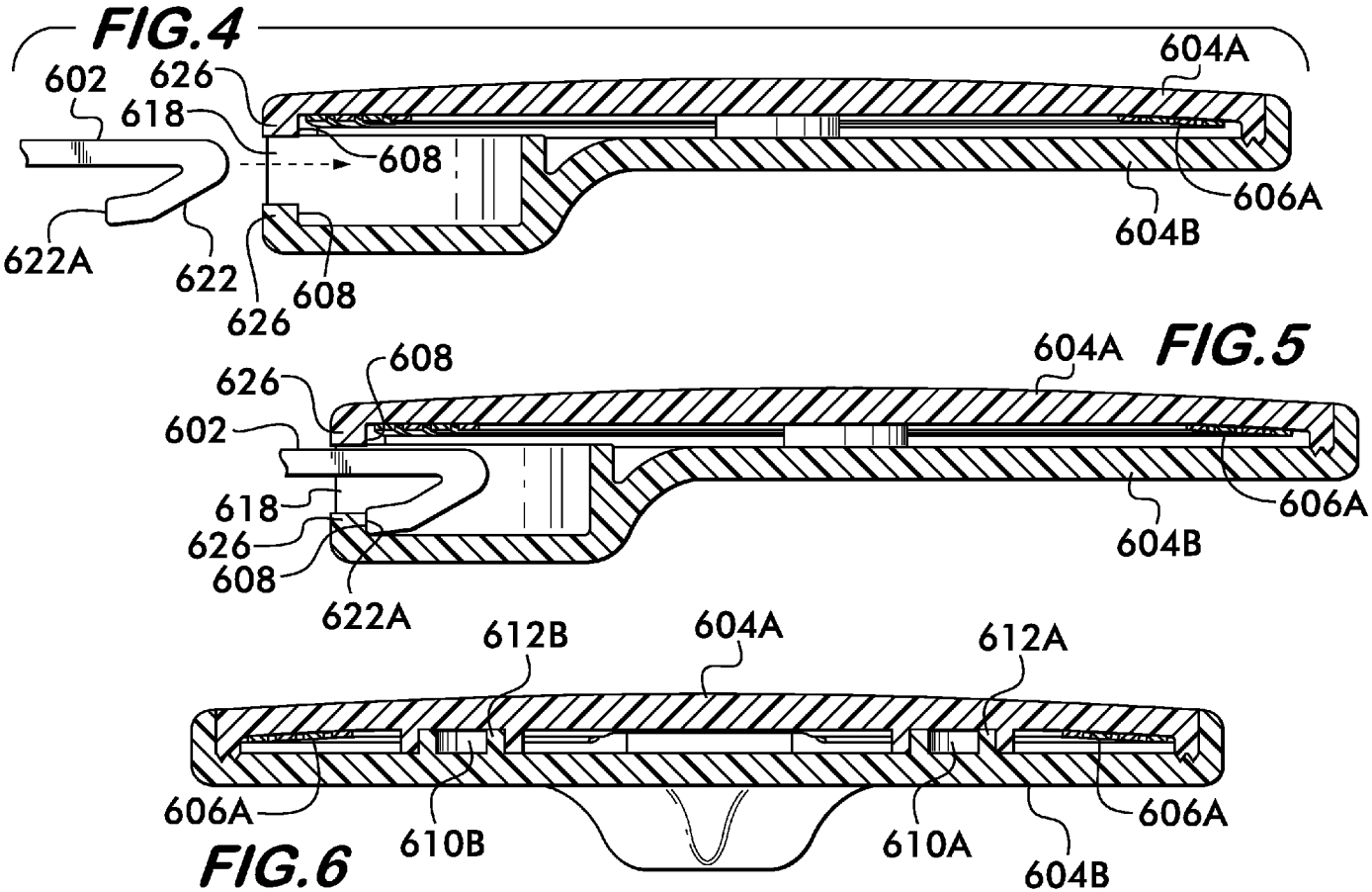
FIG. 4 is a cross-sectional view of the housing portion of the present invention taken along line 4-4 of FIG. 1 showing how the fluke portion of the attachment clip is inserted through the aperture of the locking mechanism.
FIG. 5 is a cross-sectional view of the housing portion also taken along line 4-4 showing the fluke of the attachment clip secured within the locking mechanism.
FIG. 6 is a cross-sectional view of the housing portion of the present invention taken along line 6-6 of FIG. 1.

The attachment clip 602 includes a first portion that secures to the article (see FIGS. 7-13) and also includes a second portion 622 (FIG. 5) that is captured by the non-ferrous locking mechanism 608 within the housing 604. As mentioned previously, the entire attachment clip 602 is non-ferrous, e.g., plastic. (e.g., polyethylene, PVC (poly vinyl chloride) including polymers, other plastic materials, acrylonitrile-butadiene-styrene). The second portion 622 of the attachment clip 24 (see FIGS. 4-5 and 7-13) comprises a bent or "hooked" end which are hereinafter referred to as a "fluke". As shown in FIGS. 4-5, when the housing 604 is to be coupled to the attachment clip 602, the fluke 622 is slid through the aperture 618 where the fluke 622 is initially compressed as it passes through the opening 618 and then flexes open again such that the extreme end of the fluke, barb edge 622A, is locked against a stop 608 in the second portion 604B. As disclosed in the parent application, namely, A Ser. No. 12/482,934, which is incorporated by reference herein, an aperture wall 626, along with the stop 608 thickness (e.g., approximately ½ inch), form a fluke support that resists the deformation of the fluke 622 should a would-be thief attempt to pull or tug on the attachment clip 602 to disengage it from the housing 604.

It should be understood that, as shown in FIG. 4, there are two stops 608 for locking the barb 622A against, depending on how the fluke 622 is oriented as it is inserted into the opening 618. For example, as shown in FIG. 4, with the fluke 622 positioned in a downward orientation, the barb 622A lodges against the stop 608 in the second portion 604B. Alternatively, as shown in FIGS. 7-11 and 13, with the fluke 622 oriented as shown, the barb 622A will lodge against the stop 608 in the first portion 604A (see FIG. 4) when inserted through the opening 618. Thus, as mentioned earlier, the pad 623 (FIG. 3) is provided to which a portion of the coil 606A is adhered to prevent the entry of the fluke 622 and barb 622A from snagging the coil 606A.

Figure 7:
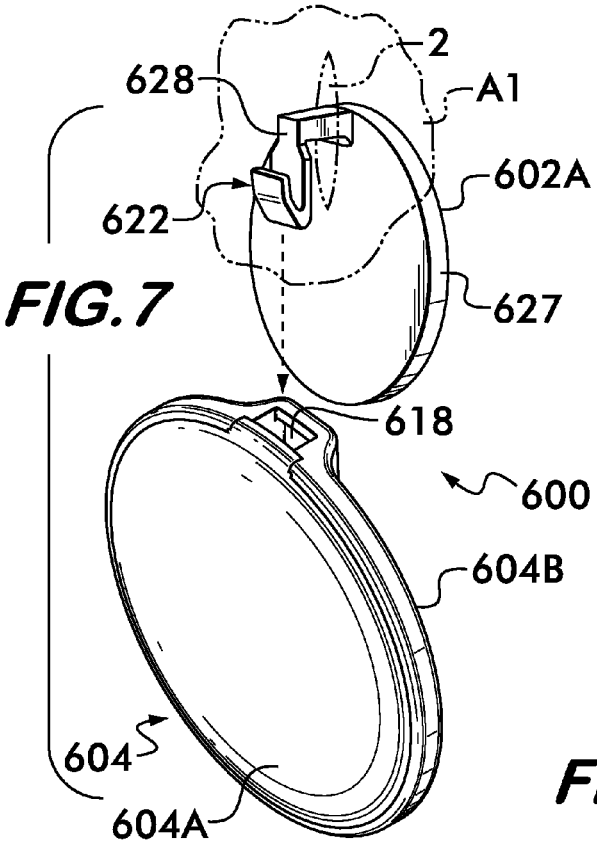
FIG. 7 is an isometric view of the security tag of the present invention for use with a article using a button-hole type of attachment clip.

FIG. 7 depicts a button-hole type of attachment clip 602A for use with an article A1 (e.g., a coat or jacket, etc.). In particular, the attachment clip 602A comprises a blocking member 627 (e.g., a disc) having the fluke 622 integrated therein. When the article is being manufactured, the blocking member 627 is placed against the article A1 and the fluke 622 is positioned through what later becomes the button hole 2 during coat manufacturing. As a result, the blocking member 627 is secured to the article A1 and cannot be removed without damaging the article A1. The coat, with the attachment clip 602A secured thereto, is then shipped to the distributor, or retailer, etc., where the housing 604 is then coupled via the fluke 622/locking mechanism 608, as described previously. Once the item is validly purchased, the customer can cut or sever (e.g., using a scissors, or a knife, etc.) the fluke at location 628 to remove both the housing 604 and the disc 627 from the article A1. It should be understood that although attachment clip 602A uses a blocking member 627 formed into a disc, this is by way of example only; a variety of different shapes could work easily as well. In fact, any member larger than the button hole 2 would suffice in that such a member would be "blocked" or prevented from passing through the button hole 2.

Figure 8:
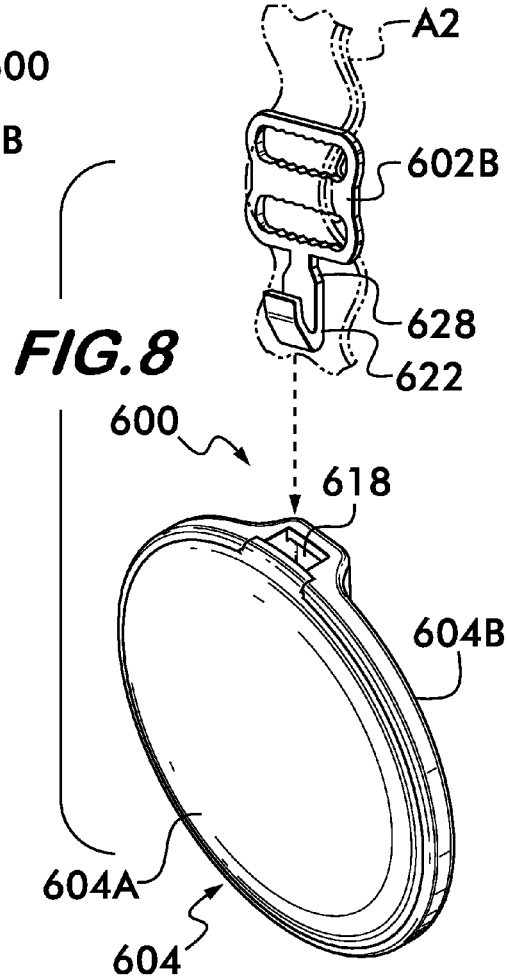
FIG. 8 is an isometric view of the security tag of the present invention for use with an article using an adjustment bracket type of attachment clip.

FIG. 8 depicts an adjustment bracket type of attachment clip 602B for use with an article A2 (e.g., a brassiere strap, water goggles, etc.) whose tightness for wear can be adjusted. In particular, the present invention integrates the fluke 622 with this adjustment bracket. Therefore, during article manufacture, the adjustment bracket 602B is positioned on the article A2 in its normal course. The article A2 is then shipped to the distributor, or retailer, etc., where the housing 604 is then coupled via the fluke 622/locking mechanism 608, as described previously. Once the item is validly purchased, the customer can cut or sever the fluke at location 628 to remove the housing 604 from the article A2. It should be noted that the adjustment function of the attachment clip 602B remains unhindered once the fluke 622 is cut or severed from the attachment clip 602B.

Figure 9:
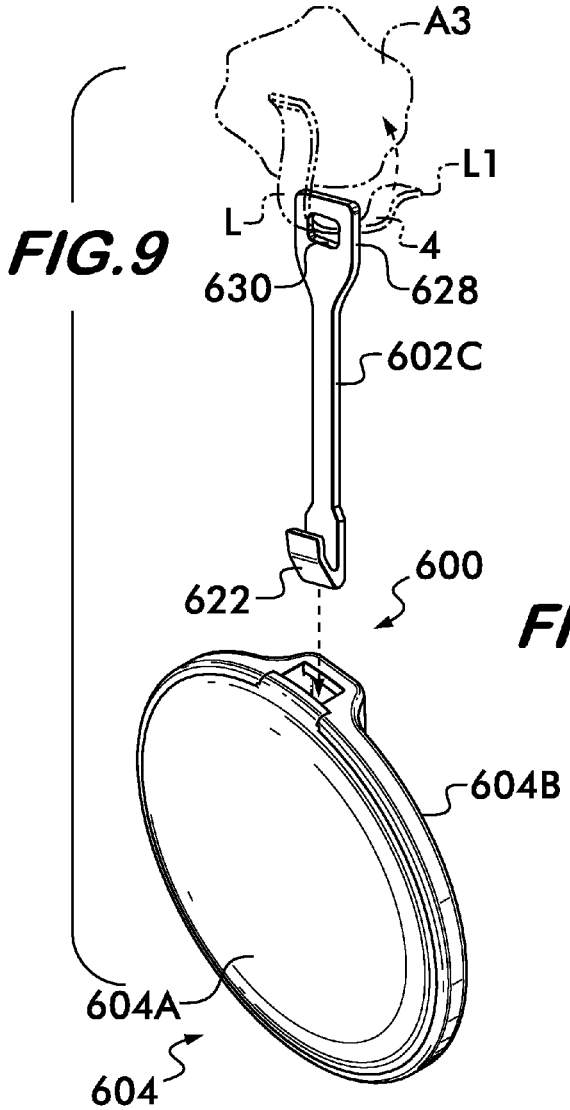
FIG. 9 is an isometric view of the security tag of the present invention for use with an article using pass-through type of attachment clip.

FIG. 9 depicts a "pass-through" type of attachment clip 602C for use with article A3 having loops (e.g., pants, jackets, etc.). In particular, the attachment clip 602C comprises an aperture 630 at a first end. During the manufacture of the pants, before one of the belt loops L is closed, a free end L1 of the loop L is passed through the aperture 630 and then the free end L1 is attached to the pants; thus, the attachment clip 620C is secured to the article A3. The article A3 is then shipped to the distributor, or retailer, etc., where the housing 604 is then coupled via the fluke 622/locking mechanism 608, as described previously. Once the item is validly purchased, the customer can cut or sever the fluke at location 628 to remove the housing 604 from the article A3.

Figure 10:
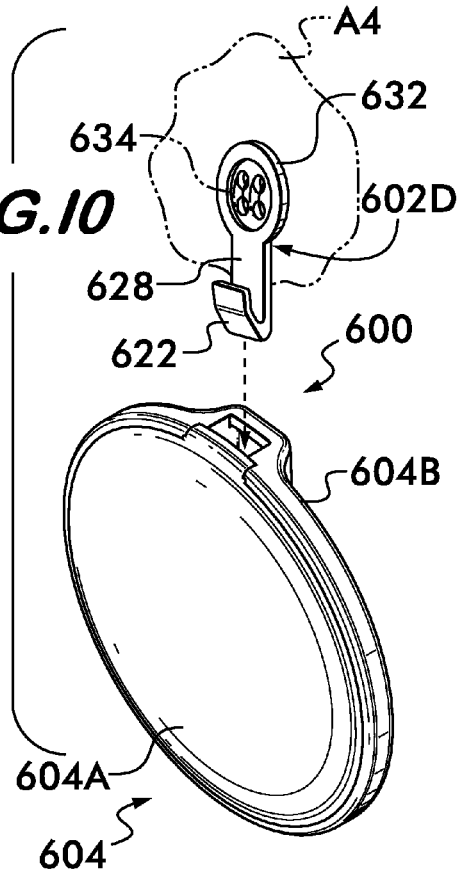
FIG. 10 is an isometric view of the security tag of the present invention for use with an article using a sew-on type of attachment clip.

FIG. 10 depicts a "sew-on" type of attachment clip 602D for use with an article A4. In particular, the attachment clip 602D comprises a first end 632 that mimics a button design having apertures for receiving threads 634 to secure the attachment clip 602D to the article A4. During the manufacture of the article A4, the first end 632 is sewn to the article A4. The article A4 is then shipped to the distributor, or retailer, etc., where the housing 604 is then coupled via the fluke 622/locking mechanism 608, as described previously. Once the item is validly purchased, the customer can cut or sever the fluke at location 628 to remove the housing 604 from the article A4; alternatively, the threads 634 can be severed by the customer to remove the first end 632.

Figure 11:
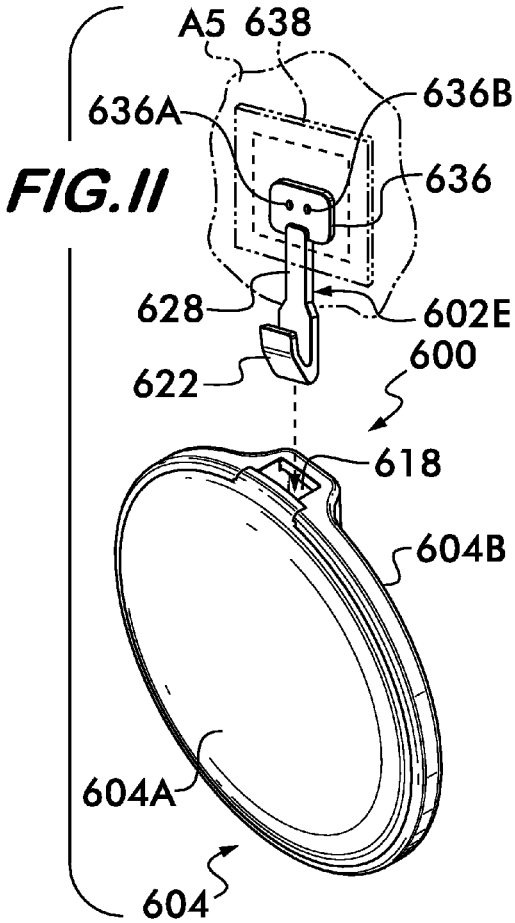
FIG. 11 is an isometric view of the security tag of the present invention for use with an article using a fabric type of attachment clip.

FIG. 11 depicts a fabric type of attachment clip 602E for use with an article A5. In particular, the attachment clip 602E comprises a first end 636 that can be either welded (e.g., ultrasonic), or sewn to, a piece of fabric 638 that is then sewn or otherwise coupled to the article A5. As can be seen in FIG. 11, the first end 636 comprises apertures 636A/636B for receiving threads (not shown) for alternatively securing to the piece of fabric 638. The article A5 is then shipped to the distributor, or retailer, etc., where the housing 604 is then coupled via the fluke 622/locking mechanism 608, as described previously. Once the article A5 is validly purchased, the customer can cut or sever the fluke at location 628 to remove the housing 604 from the article A5; alternatively, the threads (not shown) passed through the apertures 636A/636B can be severed by the customer to remove the first end 632; another alternative would be to sever threads (also not shown) that couple the fabric 638 to the article A5.

Figure 12:
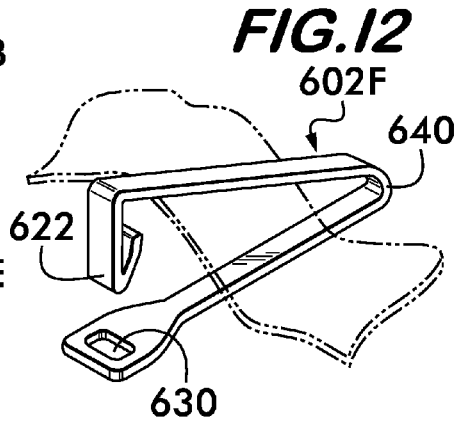
FIG. 12 is an isometric view of an attachment clip that forms a clamp type of securement to the article.
Figure 13:
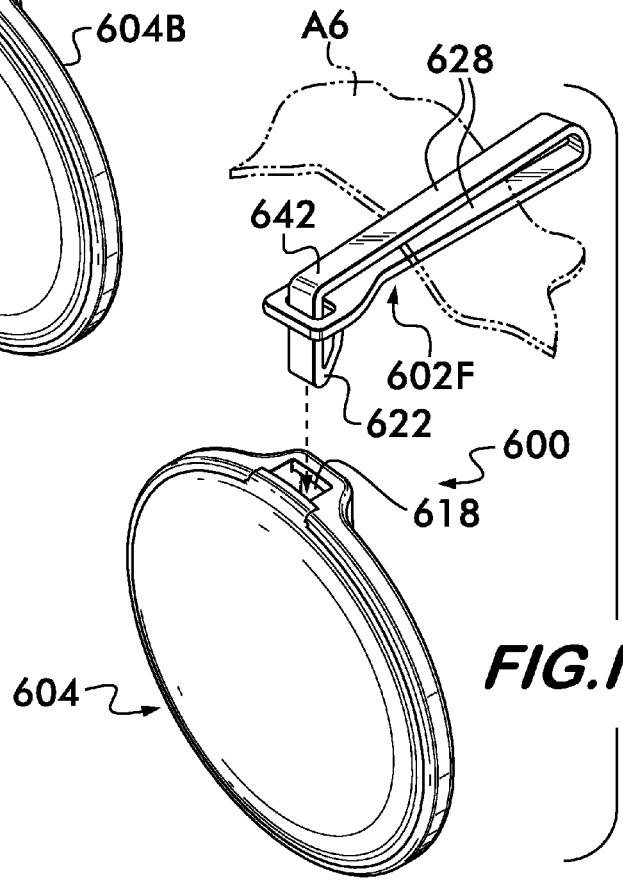
FIG. 13 is an isometric view of the security tag of the present invention using the clamp type of attachment clip shown in FIG. 12.

FIGS. 12-13 depict a clamp type of securement attachment clip 602F for use with an article A6. The attachment clip 602F comprises a design similar to that of 602C but folded to form a clamp. In particular, the attachment clip 602F comprises the aperture 630 at a first end and the fluke 622 at the other end with a living hinge 640 formed between them. To secure the attachment clip 602F to the article A6, the attachment clip 602F is positioned around a portion of the article A6 that permits the fluke 622 to be aligned with the aperture 630 (without interference from the article A6). The fluke 622 is then passed through the aperture 630 which compresses the fluke 622. Once the fluke 622 passes completely through the aperture 630, the fluke 622 expands and abuts a portion 642 of the attachment clip 602F, thereby securing the attachment clip 602F to the article A6. The article A6 is then shipped to the distributor, or retailer, etc., where the housing 604 is then coupled via the fluke 622/locking mechanism 608, as described previously. In particular, as shown most clearly in FIG. 13, with the fluke 622 remaining passed through the aperture 630, a shank portion 642 is pushed such that the fluke 622 portion is inserted into the aperture 618 and into the locking mechanism 608. Once the article A6 is validly purchased, the customer can cut or sever the fluke at locations 628 to remove the security tag 600 from the article A6.

Thus, the present invention 600 satisfies a need for a low cost, non-ferrous, lightweight, deactivatable hard tag that can be easily formed in a two stage process, namely, securing an attachment clip to the article first and then securing a housing, comprising a security element, at a later time and/or location.

While the invention has been described in detail and with reference to specific examples thereof, it will be apparent to one skilled in the art that various changes and modifications can be made therein without departing from the spirit and scope thereof.

What is claimed is:

1. A security tag adapted for securing to an article, said security tag comprising:

a housing;

a locking mechanism associated with said housing;

an attachment clip comprising:

a first portion configured to secure to the article independently of said housing; and a second portion configured to secure within said locking mechanism of said housing; and a security element associated with said housing, said security element preventing or hindering a theft of the article.

2. The security tag of claim 1 wherein said second portion is configured to secure within said locking mechanism after said first portion is secured to the article.

3. The security tag of claim 2 wherein said security element is a deactivatable security element.

4. The security tag of claim 3 wherein said second portion comprises an end having a fluke that compresses as it passes through an aperture in said housing and expands once it passes through said aperture.

5. The security tag of claim 4 wherein said first portion comprises an aperture that can be passed through a portion of the article.

6. The security tag of claim 5 wherein said attachment clip is folded and wherein said fluke passes through said aperture in said first portion for securing said attachment clip to the article and for securing said attachment clip to said housing.

7. The security tag of claim 6 wherein said fluke comprises a barb having an end that seats against a portion of said attachment clip after said fluke passes through said aperture in said first portion and expands and wherein said barb end seats against a stop positioned in said housing once said fluke passes through said aperture in said housing and expands.

8. The security tag of claim 3 wherein said first portion comprises a blocking member that cannot pass through an opening in the article and wherein said second portion comprises a fluke that compresses as it passes through an aperture in said housing and expands once it passes through said aperture.

9. The security tag of claim 3 wherein said first portion comprises an adjustment bracket and said second portion comprises a fluke that compresses as it passes through an aperture in said housing and expands once it passes through said aperture.

10. The security tag of claim 3 wherein said first portion comprises a plurality of apertures through which threads can be passed for securing said attachment clip to the article and wherein said second portion comprises a fluke that compresses as it passes through an aperture in said housing and expands once it passes through said aperture.

11. The security tag of claim 3 wherein said first portion comprises a surface that is secured to a fabric element and wherein said fabric element is secured to the article.

12. The security tag of claim 4 wherein said fluke comprises a barb having an end that seats against a stop positioned in said housing once said fluke expands.

13. The security tag of claim 1 wherein said security element responds to a magnetic or electromagnetic field of a particular frequency or frequencies.

14. The security tag of claim 13 wherein said security element comprises an electronic article surveillance (EAS) element, or a radio frequency identification (RFID) element or a combination of both.

15. The security tag of claim 1 wherein said attachment clip is configured to be detached by a consumer.

16. The security tag of claim 15 wherein said attachment clip is configured to be removed from the article using a cutting or slicing member.

17. The security tag of claim 1 wherein said attachment clip is configured to withstand harsh manufacturing conditions.

18. The security tag of claim 1 wherein said security tag is non-ferrous.

19. A method for securing a security tag to an article, said method comprising:

(a) receiving the article, wherein an attachment clip is secured to the article, said attachment clip comprising:

a first portion configured to secure said attachment clip to the article independently of a security tag housing; and a second portion configured to secure within said housing; and (b) locking said second portion within said housing to form said security tag, said housing comprising:

a locking mechanism configured to receive said second portion of said attachment clip; and a security element.

20. The method of claim 19 wherein said attachment clip is secured at a first location where the article is assembled or manufactured and wherein said step of locking said second portion occurs at a second location different from said first location.

21. The method of claim 20 wherein said second location is where the article is presented for sale.

22. The method of claim 19 further comprising the step of deactivating said security element once a valid purchase of the article has occurred.

23. The method of claim 19 wherein said steps of receiving the article and locking said second portion are achieved using a non-ferrous attachment clip and a non-ferrous housing.

24. The method of claim 19 wherein said step of locking said second portion comprises deforming a fluke located at said second portion as said fluke enters said locking mechanism, said fluke comprising a barb that is trapped within said locking mechanism when said fluke expands.

25. The method of claim 19 wherein said security element comprises an electronic article surveillance (EAS) element, or a radio frequency identification (RFID) element or a combination of both.

26. The method of claim 19 further comprising the step of detaching said security tag from the article by a consumer.

27. The method of claim 26 wherein said step of detaching said security tag from the article by a consumer comprises the consumer using a cutting or slicing member to sever said attachment clip.

28. The method of claim 26 wherein said step of detaching said security tag from the article by a consumer comprises severing threads that secure said first portion of said attachment clip to the article.

29. A method for securing a security tag to an article, said method comprising:

(a) securing an attachment clip to the article wherein said attachment clip comprises a first portion for securing to the article and a second portion which is adapted for securing to a housing of the security tag, and wherein said step of securing an attachment clip to the article is accomplished with said second portion remaining uncoupled to said housing; and (b) locking said second portion of said attachment clip within said housing having a security element therein, wherein said housing comprises a locking mechanism configured to receive said second portion of said attachment clip.

30. The method of claim 29 wherein said step of securing an attachment clip comprises passing a portion of the article through an aperture in said first portion and then securing the portion of the article to the article.

31. The method of claim 29 wherein said step of securing an attachment clip comprises clamping a portion of the article with said attachment clip that is folded so that said fluke protrudes through an aperture in said first portion.

32. The method of claim 29 wherein said step of securing an attachment clip comprises forming an aperture in the article by having a said first portion, larger than said aperture in the article, positioned on one side of the aperture in the article and having said second portion positioned on the other side of the aperture in the article.

33. The method of claim 29 wherein step of securing an attachment clip comprises providing an adjustment bracket having said fluke coupled to a portion thereof, said step of securing said attachment clip further comprises looping a portion of the article through said adjustment bracket.

34. The method of claim 29 wherein said step of securing an attachment clip comprises providing a plurality of apertures at said first portion and passing threads through said plurality of apertures to secure said attachment clip to the article.

35. The method of claim 29 wherein step of securing an attachment clip comprises attaching said first portion to a piece of fabric and then securing said piece of fabric to the article.

36. The method of claim 35 wherein said step of attaching said first portion comprises ultrasonically welding said first portion to said piece of fabric.

37. The method of claim 29 wherein said step of securing an attachment clip further comprises exposing said attachment clip to harsh manufacturing conditions while attached to the article but prior to said step of locking said second portion of said attachment clip within said housing.

38. An attachment clip for securing a security element to an article, said attachment clip comprising a first portion configured to secure to the article and a second portion configured to couple to a housing comprising said security element therein.

39. The attachment clip of claim 38 being configured to withstand harsh manufacturing conditions when attached to the article and prior to securement of said security element to said attachment clip.

40. A security element apparatus adapted for permanently coupling to an attachment clip that is secured to an article, said security element apparatus comprising:

a housing;

a security element associated with said housing, said security element preventing or hindering a theft of the article when said housing is attached to said attachment clip; and a locking mechanism associated with said housing and adapted for permanently receiving a portion of the attachment clip attaching said security tag to the article; and wherein said attachment clip is configured to secure said attachment clip to the article independently of said housing.

41. The security element apparatus of claim 40 wherein said security element is a deactivatable security element.

* * * * *